US006386403B2

(12) United States Patent
Parsons et al.

(10) Patent No.: US 6,386,403 B2
(45) Date of Patent: May 14, 2002

(54) GAS-DRIVEN LIQUID DISPENSER EMPLOYING SEPARATE PRESSURIZED-GAS SOURCE

(75) Inventors: Natan E. Parsons, Brookline, MA (US); Emanuel C. Ebner, Jr., Hudson, NH (US)

(73) Assignee: Arichell Technologies, Inc., West Newton, MA (US)

( * ) Notice: Subject to any disclaimer, the term of this patent is extended or adjusted under 35 U.S.C. 154(b) by 0 days.

(21) Appl. No.: 09/773,153

(22) Filed: Jan. 31, 2001

Related U.S. Application Data

(62) Division of application No. 09/309,626, filed on May 11, 1999, now Pat. No. 6,276,565.

(51) Int. Cl.[7] ..... B65D 83/00

(52) U.S. Cl. ..... 222/399; 222/181.3; 222/394

(58) Field of Search ..... 222/52, 504, 63, 222/181.2, 181.3, 394, 330, 399

(56) References Cited

U.S. PATENT DOCUMENTS

| | | | | |
|---|---|---|---|---|
| 2,781,152 A | | 2/1957 | Slyke | 222/81 |
| 3,558,010 A | | 1/1971 | Zenger | 222/5 |
| 3,639,920 A | | 2/1972 | Griffin et al. | 4/166 |
| 3,679,104 A | | 7/1972 | Giroud | 222/396 |
| 3,712,512 A | | 1/1973 | Snider, Jr. et al. | 222/67 |
| 3,815,793 A | | 6/1974 | Morane et al. | 222/399 |
| 3,871,554 A | | 3/1975 | Huck | 222/96 |
| 4,136,802 A | | 1/1979 | Mascia et al. | 222/95 |
| 4,258,865 A | | 3/1981 | Vahl et al. | 222/213 |
| 4,370,997 A | | 2/1983 | Braithwaite et al. | 137/116.3 |
| 4,402,429 A | | 9/1983 | Driessche | 222/153 |
| 4,408,701 A | * | 10/1983 | Jeans | 222/399 |
| 4,557,728 A | | 12/1985 | Sealfon et al. | 604/134 |
| 4,645,094 A | | 2/1987 | Acklin et al. | 222/52 |
| 4,722,372 A | | 2/1988 | Hoffman et al. | 141/98 |
| 4,781,689 A | | 11/1988 | Sealfon et al. | 604/134 |
| 4,839,039 A | | 6/1989 | Parsons et al. | 210/143 |
| 4,946,070 A | | 8/1990 | Albert et al. | 222/52 |
| 4,946,072 A | | 8/1990 | Albert et al. | 222/105 |
| 4,991,742 A | | 2/1991 | Chang | 222/95 |
| 5,014,886 A | | 5/1991 | Sams | 222/399 |
| 5,110,012 A | | 5/1992 | Scholle et al. | 222/83.5 |
| 5,110,014 A | | 5/1992 | Doundoulakis | 222/396 |
| 5,139,179 A | | 8/1992 | Cecil | 222/399 |
| 5,255,822 A | | 10/1993 | Mease et al. | 222/63 |
| 5,323,932 A | | 6/1994 | Bauman | 222/96 |
| 5,329,975 A | | 7/1994 | Heitel | 141/17 |
| 5,356,051 A | | 10/1994 | Azuma et al. | 222/396 |
| 5,368,207 A | | 11/1994 | Cruysberghs | 222/396 |
| 5,392,965 A | | 2/1995 | Azuma et al. | 222/396 |
| 5,398,845 A | | 3/1995 | Meyer | 222/1 |
| 5,423,461 A | | 6/1995 | Azuma et al. | 222/396 |
| 5,439,140 A | | 8/1995 | Meyer | 222/110 |
| 5,443,186 A | | 8/1995 | Grill | 222/396 |
| 5,540,362 A | | 7/1996 | Azuma et al. | 222/642 |
| 5,544,788 A | | 8/1996 | Meyer | 222/110 |
| 5,556,005 A | | 9/1996 | Banks | 222/96 |
| 5,562,235 A | | 10/1996 | Cruysbergs | 222/396 |
| 5,625,908 A | | 5/1997 | Shaw | 4/623 |

FOREIGN PATENT DOCUMENTS

| | | |
|---|---|---|
| CA | 2024788 | 3/1991 |
| CH | 677092 A5 | 4/1991 |
| DE | 4211494 A1 | 10/1993 |
| FR | 2720620 | 12/1995 |
| GB | 2284800 A | 6/1995 |
| WO | 90/14037 | 11/1990 |

* cited by examiner

*Primary Examiner*—Henry C. Yuen
*Assistant Examiner*—Melvin A. Cartagena
(74) *Attorney, Agent, or Firm*—Cesari and McKenna, LLP

(57) ABSTRACT

An object sensor (18) detects an object such as a hand (20) and operates a valve (52) that permits liquid soap (86) to flow from a disposable soap container (12). The liquid soap is typically quite viscous but tends to be expelled because of pressure applied from a carbon-dioxide cartridge (32). A pressure-regulator assembly (40) permits gas from the carbon dioxide cartridge (32) to enter the soap container (28) only so long as the soap container's internal pressure is less than a predetermined maximum.

26 Claims, 7 Drawing Sheets

GAS-DRIVEN LIQUID DISPENSER EMPLOYING SEPARATE PRESSURIZED-GAS SOURCE

CROSS-REFERENCE TO RELATED APPLICATIONS

The present application is a divisional of commonly assigned U.S. patent application Ser. No. 09/309,626, which was filed on May 11, 1999, by Parsons et al. for a Gas-Driven Liquid Dispenser Employing Separate Pressurized-Gas Source and has now issued as U.S. Pat. No. 6,276,565, and it is related to U.S. patent application Ser. No. 09/220,425, which was filed on Dec. 24, 1998, by Parsons et al. for a Pressure-Compensated Liquid Dispenser and has now issued as U.S. Pat. No. 6,161,762.

BACKGROUND OF THE INVENTION

1. Field of the Invention

The present invention relates to liquid dispensing, particularly of viscous liquids such as liquid soap.

2. Background Information

The conservation and sanitary advantages of automatic flow control in sinks and similar installations are well known, so many public rest-room facilities have provided automatic faucets and flushers. Although there is a similar advantage to making liquid soap dispensing automatic in such installations, the popularity of doing so has not been particularly great so far.

Much of the reason for this slow acceptance is installation difficulty. Installing a liquid-soap dispenser often requires providing extra wiring. One solution to this problem is to employ battery-operated systems. This approach is now popular for retrofitting manual flushers to make them automatic, but the power required to pump liquid soap, which can be fairly viscous, is significant. This tends to make battery life in liquid-soap dispensers too short unless the batteries are unacceptably large.

SUMMARY OF THE INVENTION

As the above-mentioned Parsons et al. application for a Pressure-Compensated Liquid Dispenser indicates, we have recognized that reasonable-size batteries can afford acceptable longevity if the pumping energy is provided in the form of a pressurized fluid in refill soap containers. The pressure in the container is adequate to force the viscous liquid through the dispenser outlet at an acceptable rate, so electric (typically battery) power is needed only for flow control, not to propel the viscous liquid soap.

We have recognized that this concept can be improved by adapting a concept used in some other dispensing contexts, namely, to provide the pressurizing fluid in a container separate from the liquid to be dispensed. The container for the liquid soap or other liquid to be dispensed will tend to be considerably larger but under much lower pressure than the other container, which is a cartridge that contains the pressurizing fluid and may itself be enclosed by the other container. The cartridge contains a substance under high pressure that can be released as a gas into the liquid container to pressurize the liquid in its reservoir. The pressurizing gas flows as needed by way of a pressure regulator. The pressure regulator permits pressurizing gas to flow from the cartridge into the liquid container only so long as the resultant reservoir pressure does not exceed a predetermined limit value, which is less than the pressure that the cartridge supplies. The resultant pressure urges the liquid through an outlet in the liquid container. By storing the pressurizing fluid separately from the liquid to be dispensed, we significantly reduce the size and/or strength required of the liquid container.

In accordance with one aspect of the invention, that flow is controlled in response to an object sensor. For instance, a control circuit can permit soap flow when the sensor detects a user's hand near the outlet.

BRIEF DESCRIPTION OF THE DRAWINGS

The invention description below refers to the accompanying drawings, of which.

DETAILED DESCRIPTION OF AN ILLUSTRATIVE EMBODIMENT

Figure 1:
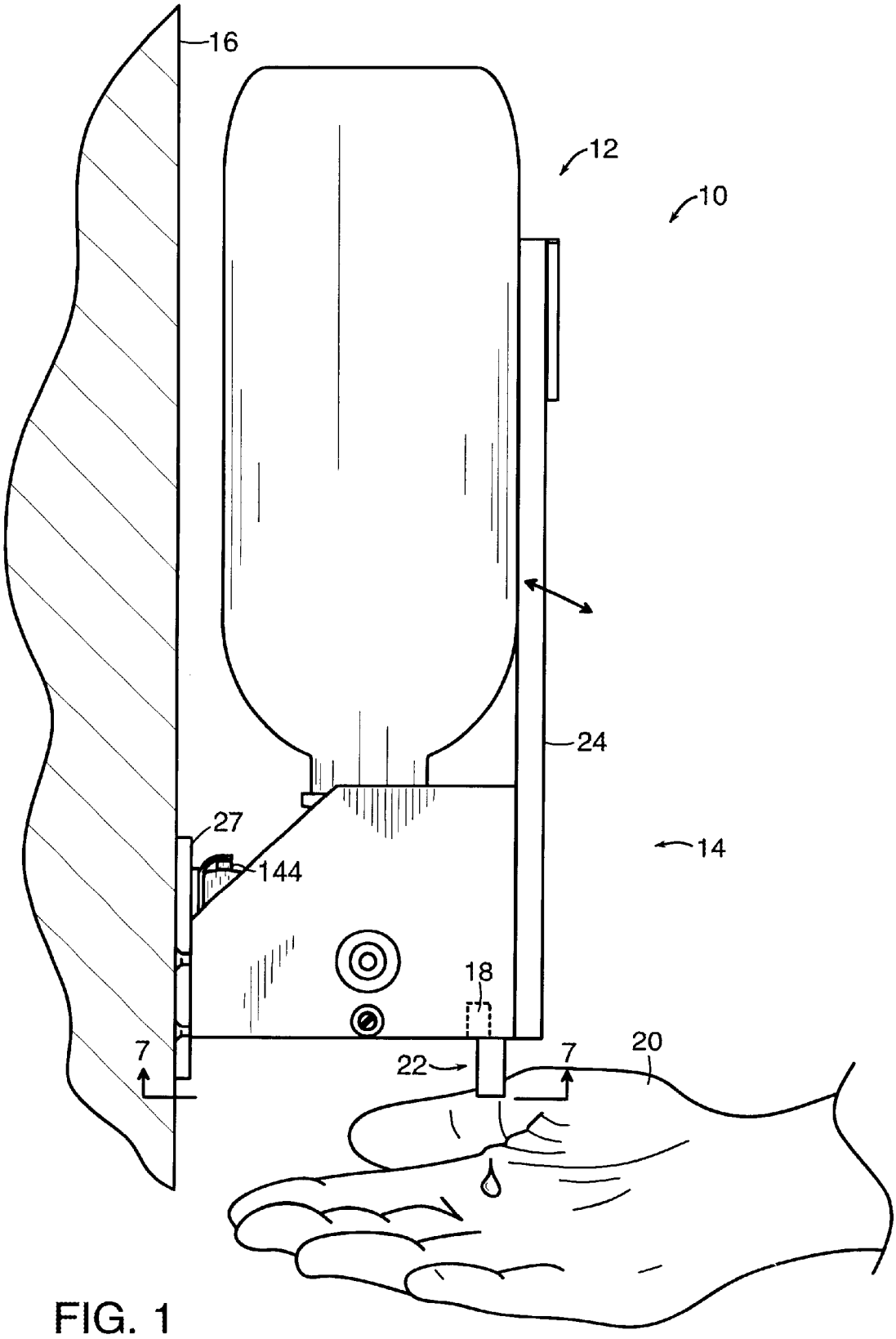
FIG. 1 is a side elevational view of a soap-dispensing station that embodies the present invention's teachings.

FIG. 1 shows in side elevation a dispensing station 10 that implements the present invention's teachings. A disposable refill unit 12 is secured to a permanent wall unit 14 mounted on a wall 16. When an object sensor 18 detects a user's hand 20, liquid soap flows through a spout 22, as will be explained presently.

Figures 2, 3:
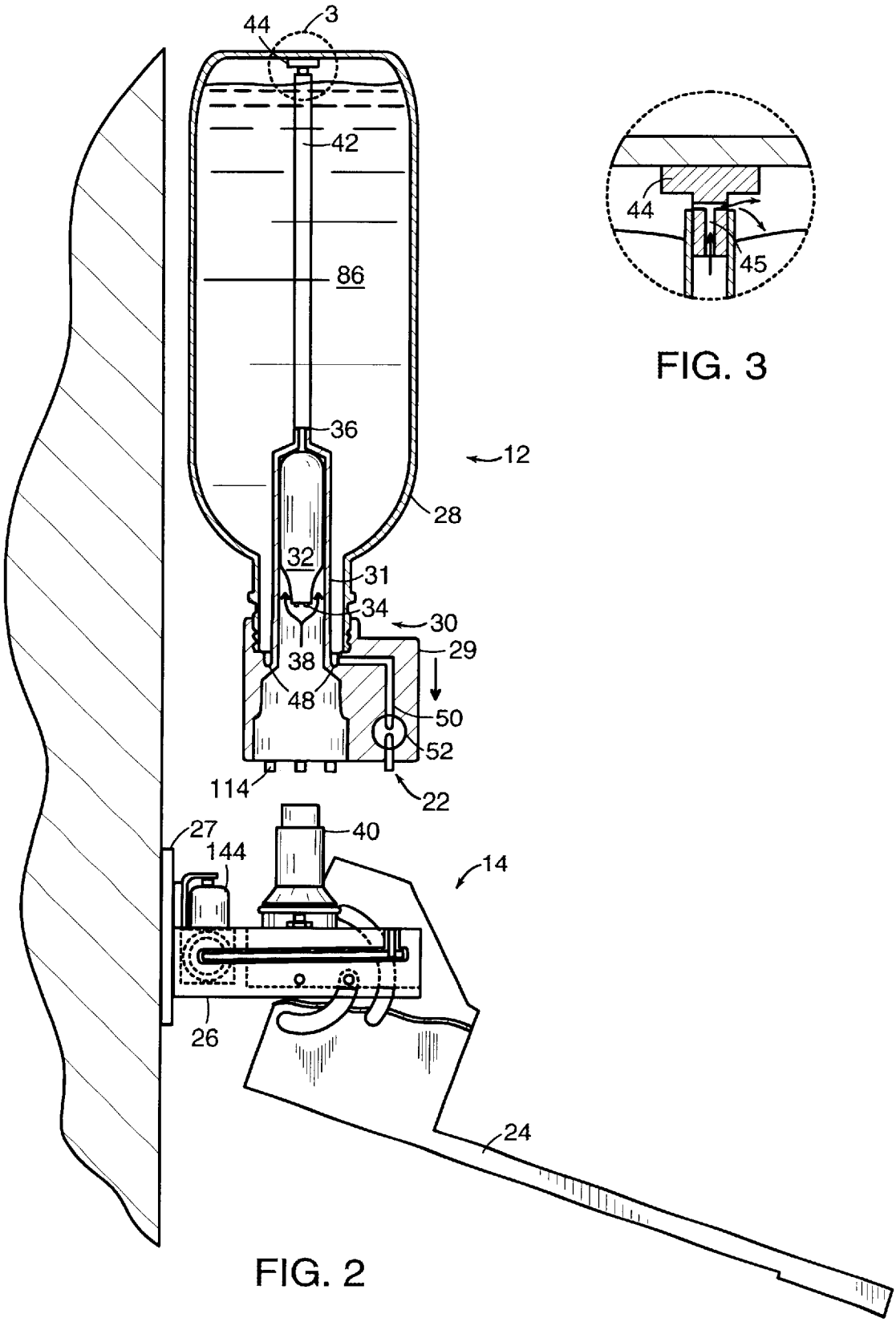
FIG. 2 is a view similar to FIG. 1, but showing the soap-dispensing station's disposable refill unit in section and separate from its permanent wall unit.
FIG. 3 is a more-detailed cross-sectional view of a stopper shown in FIG. 2.

Among the components of the permanent wall unit is a housing 24. FIG. 2 shows that the housing 24 is pivotably mounted on a bracket member 26 secured to the wall 16 by a mounting plate 27. In the illustrated position it permits the refill unit 12 to be installed and removed. The refill unit includes not only the soap container 28 itself but also a docking assembly 30 that is threadedly secured to the bottle's neck and includes a cartridge holder, which takes the form of a sleeve 31 in the illustrated embodiment. The cartridge holder contains a pressure-source cartridge 32.

Typically, the cartridge is a generally cylindrical brass vessel containing, say, carbon dioxide under high pressure. The pressure may be in the range of, say, 800 to 2900 pounds per square inch. At such pressures, the carbon dioxide is ordinarily in its liquid phase, and the amount of carbon dioxide required to provide adequate pressure even to a nearly empty soap container occupies relatively little volume. This makes it more practical to give the cartridge the strength needed to contain the high-pressure fluid. If the pressurizing fluid were instead stored in the same container as the liquid soap, it would be the relatively large container that would need to be built with the requisite pressureresisting strength. Otherwise, the container would have to be made much bigger to store the required amount of pressurizing gas at a lower pressure.

The precise pressures are not critical to realizing the present invention's advantages, but they should be such as to permit the cartridge volume to be less than, say, 5% of the liquid-container volume. Although the present invention's teachings can be practiced in systems that store the pressurizing fluid in the gas phase, pressures that result in liquid-or solid-phase storage can be used instead. In this connection, it may be considered preferable in some cases to employ a substance whose equilibrium vapor pressure at room temperature is significantly less than that of carbon dioxide. Examples are polyhalogenated hydrocarbons such as one of the FREON® refrigerants (e.g., trichlorofluoromethane). We prefer carbon dioxide because it is more benign environmentally than most such substances. Compressed nitrogen is another alternative, which may be preferred in the occasional application in which carbon dioxide is insufficiently non-reactive.

As will be described below, installing the refill unit 12 in the permanent wall unit 14 punctures a cartridge cap 34 that has theretofore prevented the cartridge 32 from releasing the pressurized carbon dioxide. The cartridge sleeve 31 forms a sleeve port 36 that communicates with axial passages 38 left between the sleeve 31's inner wall surface and the cartridge 32's outer surface. After assembly, a pressure-regulator assembly 40 cooperates with the axial paths 38 to form a pressurizer passage between the interiors of the cartridge and the soap container, as will also be explained in more detail below.

A tube 42 delivers the pressurized gas to the region above the soap surface through a stopper 44's internal passage 45, which can be seen in FIG. 3. Since the tube 42 extends above the soap surface, the soap cannot reach the pressurizer passage. The stopper 44 is shown in a position that results from its having been forced upward by pressure from the pressurizer cartridge. Before the cartridge is punctured, the stopper is in a lower position, in which the tube 42 closes off the internal passage 45. This prevents the liquid soap from entering the tube during shipping, when the illustrated orientation cannot be guaranteed.

When the soap container 28 is pressurized, the carbon dioxide tends to urge the liquid soap around the sleeve 31 through the bottle's neck into an annular channel 48 formed in the docking assembly. The annular channel 48 communicates with an outlet passage 50 also formed in the docking assembly. The liquid soap flows from channel 48 through outlet passage 50 and out through the spout 22 under control of an electrical valve that includes a valve assembly 52 and an electrical actuator, as will be explained in more detail below.

Figure 4:
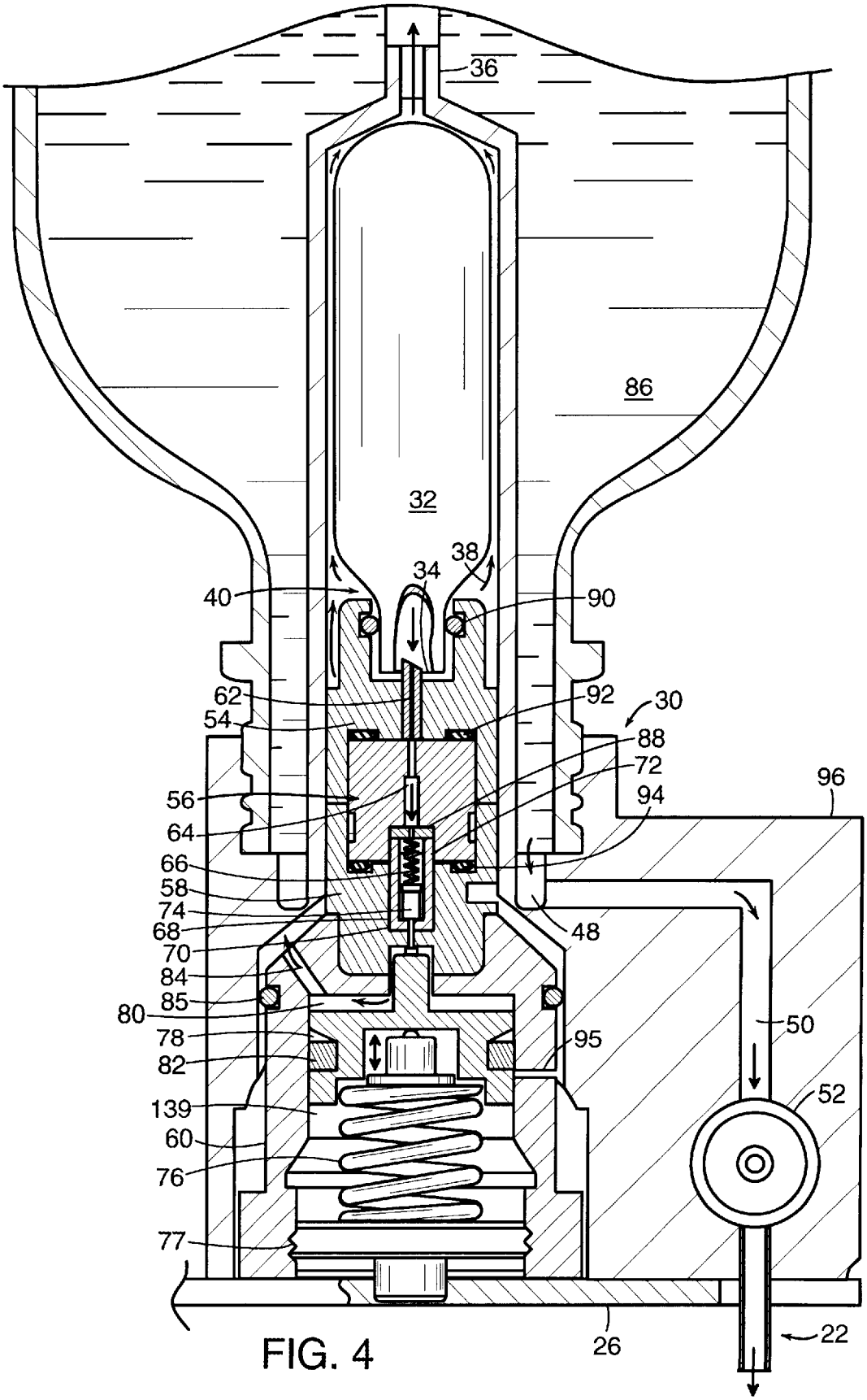
FIG. 4 is a more-detailed side sectional view of the disposable refill unit's docking assembly mated with the wall unit's pressure-regulator assembly.

FIG. 4 shows that FIG. 2's pressure-regulator assembly includes upper, middle, and lower passage-forming members 54, 56, and 58, respectively, and a body member 60 forming a bore that receives member 58. The upper passage-forming member 54 contains a cartridge-piercing cannula 62. Fluid from the cartridge 32 can flow through the cannula and a passage 64 in middle passage-forming member 56 into a valve chamber 66 formed by the middle and lower passage-forming members 56 and 58. The valve chamber 66 is fitted with a valve guide 68 at whose lower end is formed an opening and valve seat 70 into which a bias spring 72 urges a pressure-regulating valve member 74.

Countering the bias spring's force is the force that a regulator spring 76 held in place by a threadedly secured chamber plug 77 exerts through a plunger 78 slidably mounted in a low-pressure chamber 80. A seal 82 is provided between the plunger 78 and low-pressure chamber 80's interior wall.

So long as the pressure within the low-pressure chamber 80 is less than a predetermined limit value, the regulator spring 76 exerts enough force to overcome that of the bias spring 72. It thereby keeps the valve member 74 unseated. So pressurizing carbon dioxide that has flowed through the cannula 62 and middle-housing passage 64 into the valve chamber 66 can enter the low-pressure chamber 80. From that chamber, it can flow through a port 84 to the exterior of the pressure-regulator assembly 40. An O-ring seal 85 prevents the thus-escaped carbon dioxide from flowing downward, but it can flow upward through the clearance between the sleeve 31 and pressure-regulator assembly 40. From there it flows through the clearance between the sleeve 31 and the cartridge 32 to the sleeve port 36. The sleeve port 36 admits it to the soap container's interior, where it urges the soap out through the annular channel 48, outlet passage 50, and valve 52, as was mentioned above.

In flowing through this pressurizing path from the cartridge 32 to the soap container's interior, the carbon dioxide flows through a filter 88 of sintered bronze, which prevents any entrained particles from reaching the valve. It also provides a large internal surface area that aids in the fluid's phase change; at the high pressures that prevail within the cartridge, the carbon dioxide is liquid, and the high-internal-surface-area sintered bronze tends to speed the evaporation process.

This carbon-dioxide flow can occur only so long as the pressure within the low-pressure chamber 80 is below a relatively low value of, say, ten pounds per square inch above ambient. Since the cartridge pressure is much higher than this, that low limit value is rapidly exceeded, and the resultant downward force on the plunger 78 overcomes that of the regulator spring 76. The bias spring 72 accordingly seats the valve member 74 and thereby suspends carbon-dioxide flow until soap flow again results in a low enough chamber pressure. O-ring seals 90, 92, and 94 keep the high-pressure carbon dioxide trapped in the valve chamber 66 and the part of the pressurizing path upstream of it. If the valve member 74 fails to seat for some reason, the low-pressure chamber 80's pressure increases and thereby pushes the plunger 78 down farther, to the point where chamber 80 communicates with a pressure-relief port 95 that thereupon vents the high-pressure gas to the exterior.

Figure 5:
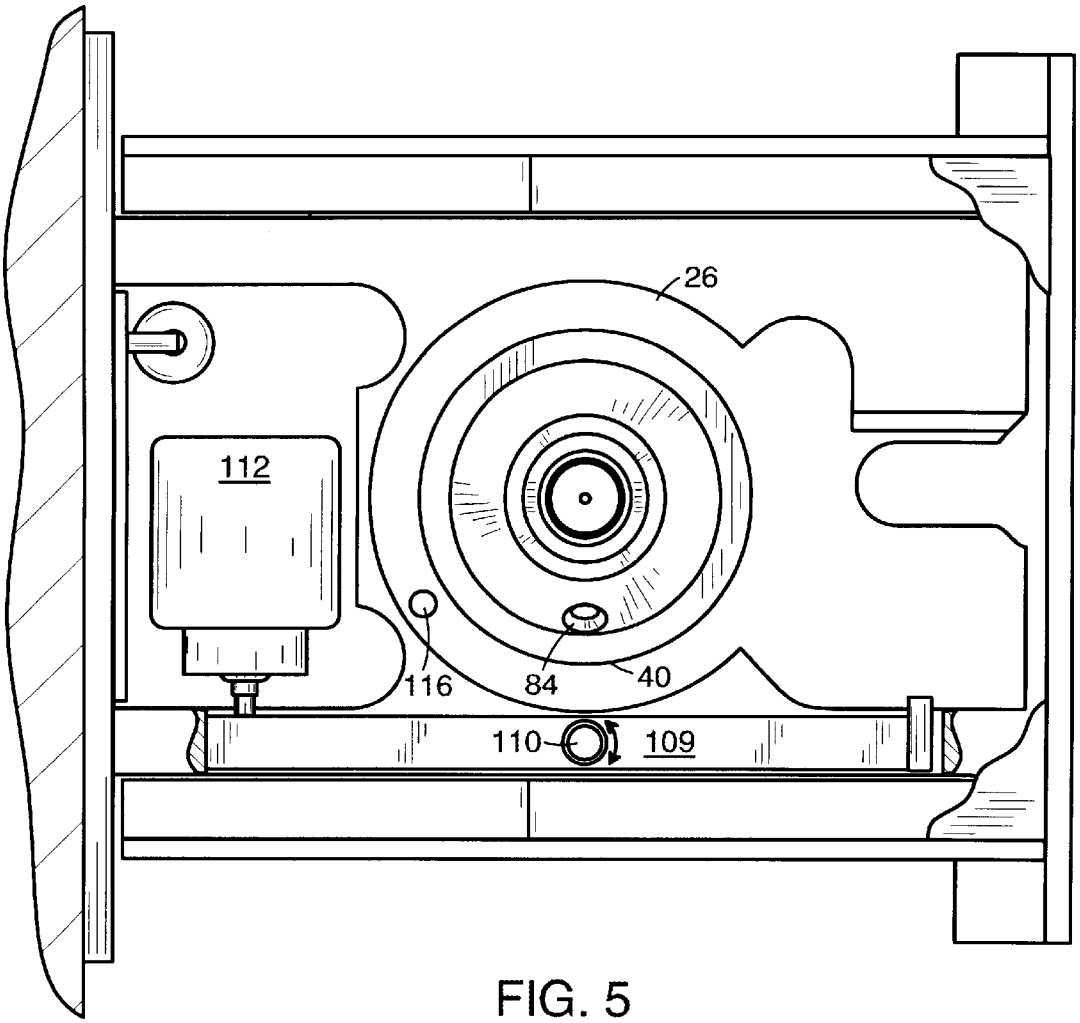
FIG. 5 is a plan view of the permanent wall unit of FIG. 2.

To understand the flow-control valve 52's operation, consider FIG. 5, in which the pressure-regulator assembly 40 can be seen as being generally circular in plan view. FIG. 4's docking assembly 30, which encloses it, is generally circular, too, except that it has a protruding shoulder 96 whose width is manifest in FIG. 6. This shoulder 96 internally forms FIG. 4's outlet passage 50.

Figure 6:
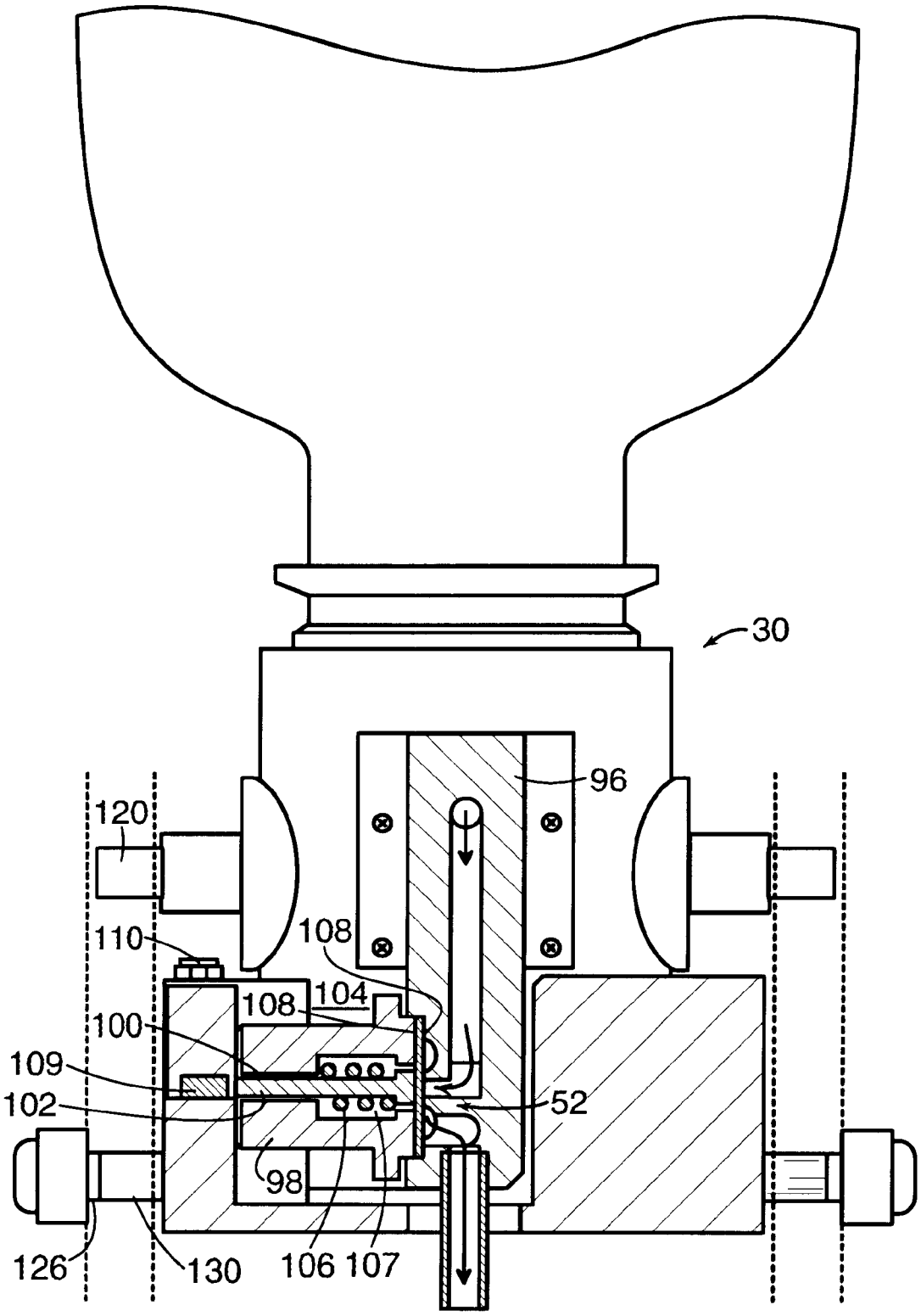
FIG. 6 is a detailed front view with the housing removed and the flow-control valve shown in cross section.

As FIG. 6 also illustrates, the shoulder 96 has the valve 52's body member 98 mounted on it. That body member 98 forms an actuator bore 100 containing an actuator rod 102 urged against a flexible diaphragm 104 by a spring 106 contained in a spring chamber 107 into which the actuator bore widens.

The diaphragm 104 is shown pressed against a dispensing valve seat 108 and thereby preventing soap flow, but the force that the spring 106 exerts against the actuator rod 102 is only great enough to prevent soap flow when the container is not yet pressurized, e.g., during shipping. Once the replacement unit has been installed and the container thus pressurized, the diaphragm remains in the seated position only when a rocker arm 109 pivotable about a pivot pin 110 is held in that position by a solenoid 112 shown in FIG. 5. When the solenoid 112 changes state in response to the sensor's detecting an object that meets control-system criteria for triggering soap dispensing, it permits the actuator rod to retract under the force that the pressurized liquid soap exerts on the diaphragm 104, and the soap accordingly flows.

Typically, the control system permits soap flow only for a predetermined duration after it has detected an appropriate target. After that duration has passed, the valve again closes. Although the predetermined duration thus does not depend on how long the user's hands remain under the dispenser, the control circuitry may minimize dose-amount variation by varying the duration in accordance with, say, the viscosity of the particular type of soap currently being dispensed. As FIG. 2 shows, the refill unit may include a tab 114 whose position indicates the contained soap's viscosity or other characteristic to which the control circuitry should respond in arriving at the proper duration. FIG. 5 shows a membrane switch 116, which is one of a plurality of such switches included in the control circuitry and provided on the surface of the bracket member 26 to sense the position(s) of the tab or tabs, if any, that the refill unit includes.

Figure 8:
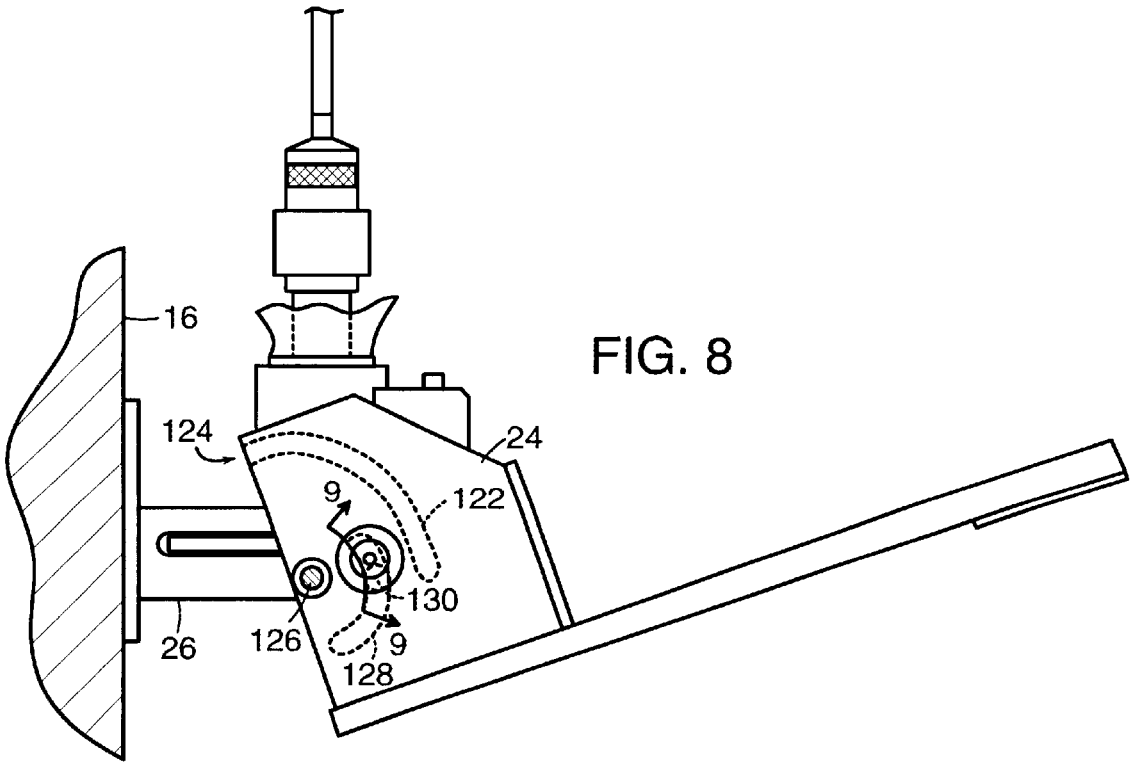
FIG. 8 is a side elevation of the dispensing unit showing its housing in a partially open position.

We now return to the installation process. As FIG. 6 illustrates, the replacement unit 12's docking assembly 30 forms cam pins 120 that engage cam slots in the housing 24's interior wall surfaces. FIG. 8 shows that cam slots 122 have open ends 124 at which the cam pins can enter them as the housing begins to close at the start of installation. The distance from the slot to the housing 24's pivot axis 126 decreases with distance from the open end. Consequently, pivoting the housing from the completely open position through the intermediate position of FIG. 8 to the closed position that FIG. 1 illustrates forces the replacement unit onto the permanent unit and punctures the cartridge to pressurize the container in the manner described above.

Figure 9:
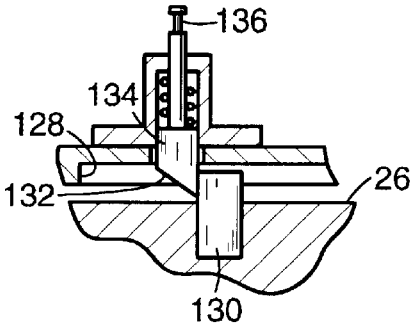
FIG. 9 is a detailed cross-sectional view of the dispensing unit's safety-latch mechanism.

Another, arcuate slot 128 formed in an interior wall face of the housing 24 accommodates a stop pin 130 provided in the bracket member 26 for safety reasons that will be explained presently. As the housing 24 pivots, the arcuate slot 128 slides along the stop pin 130. This brings the stop pin into engagement with the cam surface 132 (FIG. 9) of a spring-loaded latch pin 134 mounted on the housing wall. The stop pin thereby displaces the latch pin 134 and its pull-pin extension 136 so that the housing can continue to pivot. This brings the latch pin 134 to the other side of the stop pin 130, where it is again extended, as FIG. 9 illustrates. Pivoting continues from that position until the housing is fully closed.

When the housing is subsequently to be opened, the user pivots the housing in the direction clockwise in FIG. 8. This brings the latch pin 134 into the position that FIG. 9 illustrates. That is, the stop pin 130 meets the latch pin 134 on its flat side and thereby prevents the housing from opening completely. In this position, the replacement unit 12 has been raised enough that the seal of FIG. 4's O-ring 80 is broken slightly but still imposes a high flow resistance. This permits only gradual cartridge depressurization and thus prevents the possibly untoward results of exhausting the high-pressure gas too rapidly. To complete the opening process, the user must pull the pull pin 136 out so that the latch pin 134 no longer obstructs further pivoting.

Figure 7:
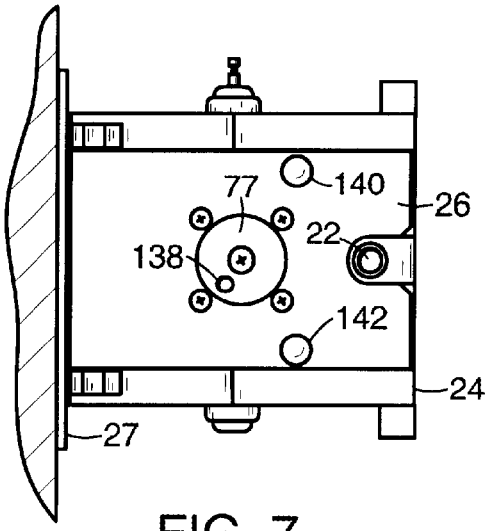
FIG. 7 is a bottom view of the dispensing station.

FIG. 7 is a bottom view of the dispenser. In the illustrated embodiment, the chamber plug 77 of FIG. 4 is visible through an opening in the bracket member 26, as is a relief hole 138 that allows air to flow in and out of FIG. 4's chamber 139 as plunger 78 moves. FIG. 7 also shows the transmitter and receiver transducers 140 and 142 of the object sensor 18.

Figure 10:
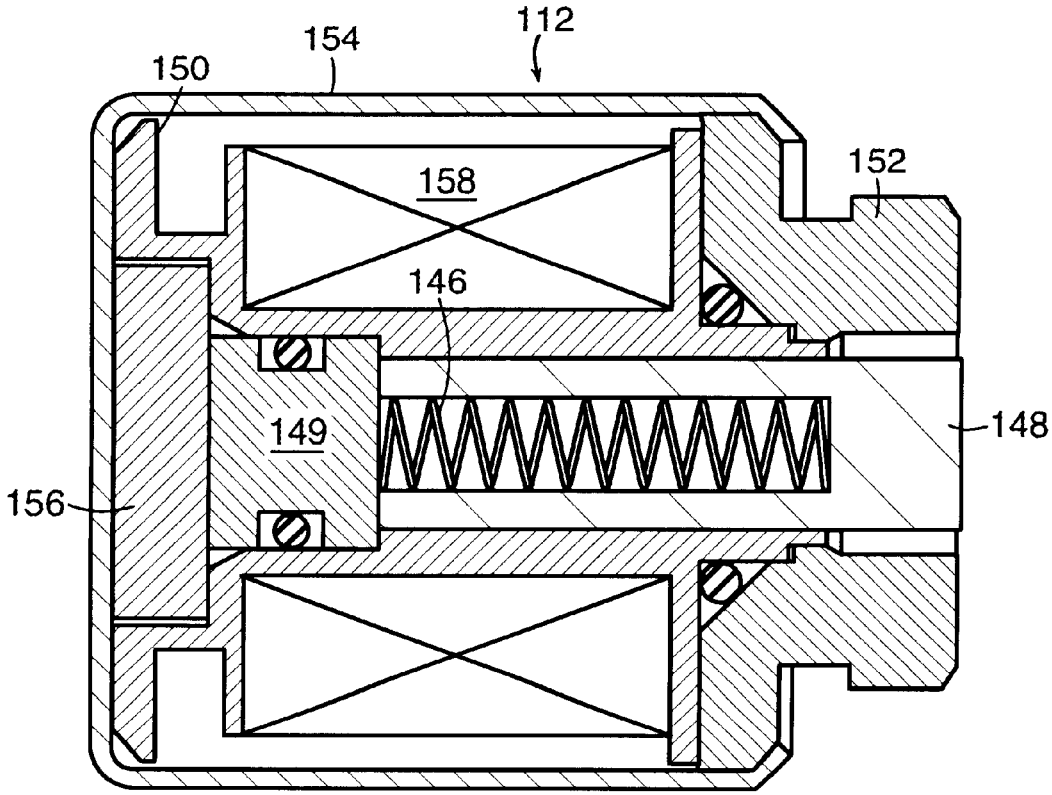
FIG. 10 is a cross-sectional view of the solenoid that the dispensing system uses for flow control.

Preferably, the power for that sensor's circuitry and the circuitry used for solenoid control is provided by batteries, so FIG. 2 depicts the unit as including batteries 144. Employing battery power is most practical if the solenoid 112 of the "latching" variety, which the solenoid of FIG. 10 exemplifies. A bias spring 146 exerts force between a ferromagnetic plunger 148 and an internal plug 149 mounted in a bobbin 150. This tends to urge the plunger 148 out through an opening in a face plug 152 mounted in a housing 154 that also encloses the bobbin 150. But a permanent magnet 156 also mounted in the bobbin 150 ordinarily retains the plunger 148 against the spring force when the plunger 148 is in the illustrated, retracted position. Since the plunger 148 thus remains in its retracted position, it does not cause the rocker arm 109 to keep the flow-control valve closed: the valve remains open.

To move the plunger 148 outward so that it forces the rocker arm 109 to close the flow-control valve, the valve-control circuitry drives current through the solenoid's windings 158 in a first direction. The magnetic flux caused by current flowing in that direction opposes the permanent magnet's flux to the extent that the magnetic force falls below the spring force, which therefore moves the plunger 148 to the outward, valve-closing position. The drive current can then stop since at that point the plunger 148 is too far from the permanent magnet 156 for the magnetic force to exceed the spring force. That is, remaining in this state does not require current flow.

To return the solenoid to the illustrated, valve-open state, the control circuitry drives current through the windings 158 in the other direction, the one in which the resultant flux reinforces the permanent magnet's flux. The total magnetic force exceeds the spring force, and the plunger returns to the illustrated position. Remaining in this state does not require current flow, either, so the solenoid is a latching solenoid, one that requires power only to change state, not to remain in either state. Using such a solenoid contributes significantly to battery life.

Although the embodiment just illustrated is advantageous, there may be situations in which other embodiments will be considered preferable. For instance, there is no reason in principle why the pressure-source cartridge needs to fit in the container that holds the soap to be expelled; it may be more convenient in some instances to provide the soap container and the pressurizing cartridge separately. Also, there is no reason in principle why the flow-controlling valve needs to be downstream from the liquid container. For example, a solenoid-operated flow-control valve may be interposed in the pressurizing path, possibly between the pressure regulator and the liquid container, and a check valve could be placed downstream of the liquid container. By operating the solenoid to open the flow-control valve, the pressure within the liquid container could be increased above that to which the check valve responds and thereby cause flow out through the spout. To stop flow, the solenoid would close the flow-control valve, thereby preventing the liquid container's pressure from being replenished as pressure is released by liquid flow out through the spout. The pressure would accordingly fall below the check-valve threshold, and the check valve would therefore stop liquid flow.

Indeed, the flow-control and regulator valves can be implemented in a common valve; the flow-controlling solenoid could ordinarily prevent the regulator valve from opening, permitting to it to open only when liquid flow is intended.

Moreover, the pressurizing gas need not be in direct contact with the liquid. For example, the actual liquid reservoir could be a collapsible pouch disposed inside the container, and the pressurizing gas would be admitted into the part of the container outside the pouch so that it tends to expel the liquid by collapsing the pouch.

Obviously, the invention can be used to dispense not only soap but also other liquids, such as catsup. (We use the term liquid broadly here.) Particularly in such embodiments, the electric valve may be operated in response to, say, manual switch operation rather than object detection by a sensor. Even installations that operate by manual switch operation may close the flow-control valve automatically after a predetermined duration.

The present invention can thus be implemented in a wide range of embodiments and constitutes a significant advance in the art.

What is claimed is:

1. A fluid-dispensing refill unit comprising:

A) a liquid container including a liquid reservoir that contains a liquid to be dispensed and has a liquid-container outlet;

B) a pressurizer port through which pressurizing fluid can enter the liquid container and so pressurize the liquid to be dispensed as to tend to urge it through the liquid-container outlet, the pressurizer port including a pressurizer tube of such a length and orientation as, when the liquid container is so oriented that the liquid to be dispensed is aided by gravity in flowing out of the liquid container by way of the outlet, to extend through the majority of the height of the container and deliver to a region above the liquid surface pressurizing fluid supplied to the pressurizer port; and C) a pressurizing cartridge that is secured to the liquid container, forms a pressurizer-fluid reservoir adapted to be placed in fluid communication with the pressurizer port, and contains a pressurizing fluid under a source pressure at least eight times as high as the pressure that prevails in the liquid reservoir.

2. A fluid-dispensing refill unit as defined in claim 1 wherein:

A) the liquid dispenser further includes a cartridge holder mounted on the container; and B) the cartridge holder contains the cartridge.

3. A fluid-dispensing refill unit as defined in claim 2 wherein the cartridge holder forms the pressurizer port and comprises a sleeve having an interior surface that defines with the exterior surface of the cartridge a pressurizer-passage segment that leads to the pressurizer port.

4. A fluid-dispensing refill unit as defined in claim 1 further including a docking assembly mounted on the liquid container and including a flow-control valve operable to control flow through the liquid-container outlet.

5. A fluid-dispensing refill unit as defined in claim 4 wherein the docking assembly includes a cartridge holder that contains the cartridge.

6. A fluid-dispensing refill unit as defined in claim 5 wherein the cartridge holder forms the pressurizer port and comprises a sleeve having an interior surface that defines with the exterior surface of the cartridge a pressurizer-passage segment that leads to the pressurizer port.

7. A fluid-dispensing refill unit as defined in claim 1 wherein the volume of the liquid container is at least twenty times that of the cartridge.

8. A fluid-dispensing refill unit as defined in claim 1 wherein the liquid to be dispensed consists essentially of liquid soap.

9. A fluid-dispensing refill unit as defined in claim 1 wherein the liquid to be dispensed consists essentially of a liquid whose viscosity exceeds that of water.

10. A fluid-dispensing refill unit as defined in claim 1 wherein the pressurizing fluid consists essentially of nitrogen.

11. A fluid-dispensing refill unit as defined in claim 1 wherein the pressurizing fluid consists essentially of carbon dioxide.

12. A fluid-dispensing refill unit as defined in claim 11 wherein the liquid to be dispensed consists essentially of liquid soap.

13. A fluid-dispensing refill unit as defined in claim 11 wherein the liquid to be dispensed consists essentially of a liquid whose viscosity exceeds that of water.

14. A fluid-dispensing refill unit as defined in claim 11 wherein the volume of the liquid container is at least twenty times that of the cartridge.

15. A fluid-dispensing refill unit as defined in claim 14 wherein the liquid to be dispensed consists essentially of liquid soap.

16. A fluid-dispensing refill unit as defined in claim 14 wherein the liquid to be dispensed consists essentially of a liquid whose viscosity exceeds that of water.

17. The fluid-dispensing refill unit as defined in claim 1 wherein the pressurizer tube includes a stopper so movably secured in the pressurizer tube as to prevent liquid from entering the pressurizer tube but be movable by introduction of the pressurizing fluid into the pressurizer to a position in which it permits the pressurizing fluid to flow out of the pressurizer tube.

18. A fluid-dispensing refill unit comprising:

A) a liquid container including a liquid reservoir that contains a liquid to be dispensed and has a liquid-container outlet;

B) a pressurizer port through which pressurizing fluid can enter the liquid container and so pressurize the liquid to be dispensed as to tend to urge it through the liquid-container outlet; and C) a pressurizing cartridge that contains a pressurizing fluid under a source pressure at least eight times as high as the pressure that prevails in the liquid reservoir, is secured to the liquid container, and forms a pressurizer-fluid reservoir adapted to be placed in fluid communication with a pressure regulator that in turn is adapted to be placed in such fluid communication with the pressurizer port as to permit the pressurizing fluid to flow from the pressurizer cartridge into the liquid container only when the fluid pressure in the container does not exceed a predetermined limit pressure less than the source pressure, and wherein the fluid-dispensing refill unit itself includes no such pressure regulator.

19. A fluid-dispensing refill unit as defined in claim 18 wherein the pressurizer port includes a pressurizer tube of such a length and orientation as, when the liquid container is oriented with the container outlet at the bottom thereof, to extend through the majority of the height of the container and deliver to a region above the liquid surface pressurizing fluid supplied to the pressurizer port.

20. A fluid-dispensing refill unit as defined in claim 18 wherein:

A) the liquid dispenser further includes a cartridge holder mounted on the container; and B) the cartridge holder contains the cartridge.

21. A fluid-dispensing refill unit as defined in claim 20 wherein the cartridge holder forms the pressurizer port and comprises a sleeve having an interior surface that defines with the exterior surface of the cartridge a pressurizer-passage segment that leads to the pressurizer port.

22. A refill unit as defined in claim 18 further including a docking assembly mounted on the liquid container and including a flow-control valve operable to control flow through the liquid-container outlet.

23. A refill unit as defined in claim 22 wherein the docking assembly includes a cartridge holder that contains the cartridge.

24. A liquid-dispenser refill unit as defined in claim 23 wherein the cartridge holder forms the pressurizer port and comprises a sleeve having an interior surface that defines with the exterior surface of the cartridge a pressurizer-passage segment that leads to the pressurizer port.

25. A fluid-dispensing system as defined in claim 18 wherein the volume of the liquid container is at least twenty times that of the cartridge.

26. A fluid-dispensing system as defined in claim 18 wherein the liquid to be dispensed consists essentially of liquid soap.

* * * * *